US006607087B2

(12) United States Patent
Turnwald

(10) Patent No.: US 6,607,087 B2
(45) Date of Patent: Aug. 19, 2003

(54) STOPPER FOR FORMING A GAS-TIGHT SEAL FOR A VARIETY OF BOTTLES

(76) Inventor: Hans Adolf Turnwald, 2893 SW. 69 Ct., Miami, FL (US) 33155

( * ) Notice: Subject to any disclaimer, the term of this patent is extended or adjusted under 35 U.S.C. 154(b) by 0 days.

(21) Appl. No.: 09/755,731

(22) Filed: Jan. 5, 2001

(65) Prior Publication Data

US 2002/0088768 A1 Jul. 11, 2002

(51) Int. Cl.[7] ..... B65D 51/16

(52) U.S. Cl. ..... 215/360; 215/364; 411/34; 138/90; 220/235

(58) Field of Search ..... 215/358, 360, 215/364; 138/90, 93, 89; 220/233–238; 411/34, 907

(56) References Cited

U.S. PATENT DOCUMENTS

| | | | | |
|---|---|---|---|---|
| 190,579 | A | * | 5/1877 | Guild |
| 408,364 | A | * | 8/1889 | Traut |
| 814,778 | A | * | 3/1906 | Gilfillan |
| 1,037,792 | A | * | 9/1912 | Morawiecki |
| 1,146,036 | A | * | 7/1915 | Spinks |
| 1,363,804 | A | * | 12/1920 | Morin |
| 3,006,680 | A | * | 10/1961 | Gregory |
| 3,667,640 | A | * | 6/1972 | Morrow ..... 138/89 |
| 3,750,822 | A | * | 8/1973 | Dubach ..... 215/361 |
| 4,380,302 | A | * | 4/1983 | Broad ..... 220/235 |
| 4,671,518 | A | * | 6/1987 | Retz |
| 6,273,655 | B1 | * | 8/2001 | McAlpine et al. ..... 411/34 |

FOREIGN PATENT DOCUMENTS

| | | | |
|---|---|---|---|
| DE | 3622249 | * | 1/1988 |
| DE | 196 30 729 | * | 2/1998 |
| EP | 161916 | * | 11/1985 |
| JP | 8-151060 | * | 6/1996 |

* cited by examiner

*Primary Examiner*—Robin Hylton
(74) *Attorney, Agent, or Firm*—Alcoba Edson, P.A.; Ruben Alcoba; Laurence J. Edson

(57) ABSTRACT

An adjustable bottle stopper that stoppers a bottle by expanding a cylindrical elastic spacer within the neck of the bottle. According to the invention, the bottle comprises of: a threaded disk nut, a bolt that is screwed into said threaded disk nut, a lower pressure stamp nut in which the above assembly is screwed into, a cylindrical elastic spacer that is mounted on said bolt after performing the above steps, an upper pressure stamp that is mounted on the bolt after the mounting of the cylindrical elastic spacer, a handle nut which is screwed and locked on said bolt after said upper pressure stamp is mounted.

7 Claims, 2 Drawing Sheets

STOPPER FOR FORMING A GAS-TIGHT SEAL FOR A VARIETY OF BOTTLES

BACKGROUND

Figure 1:
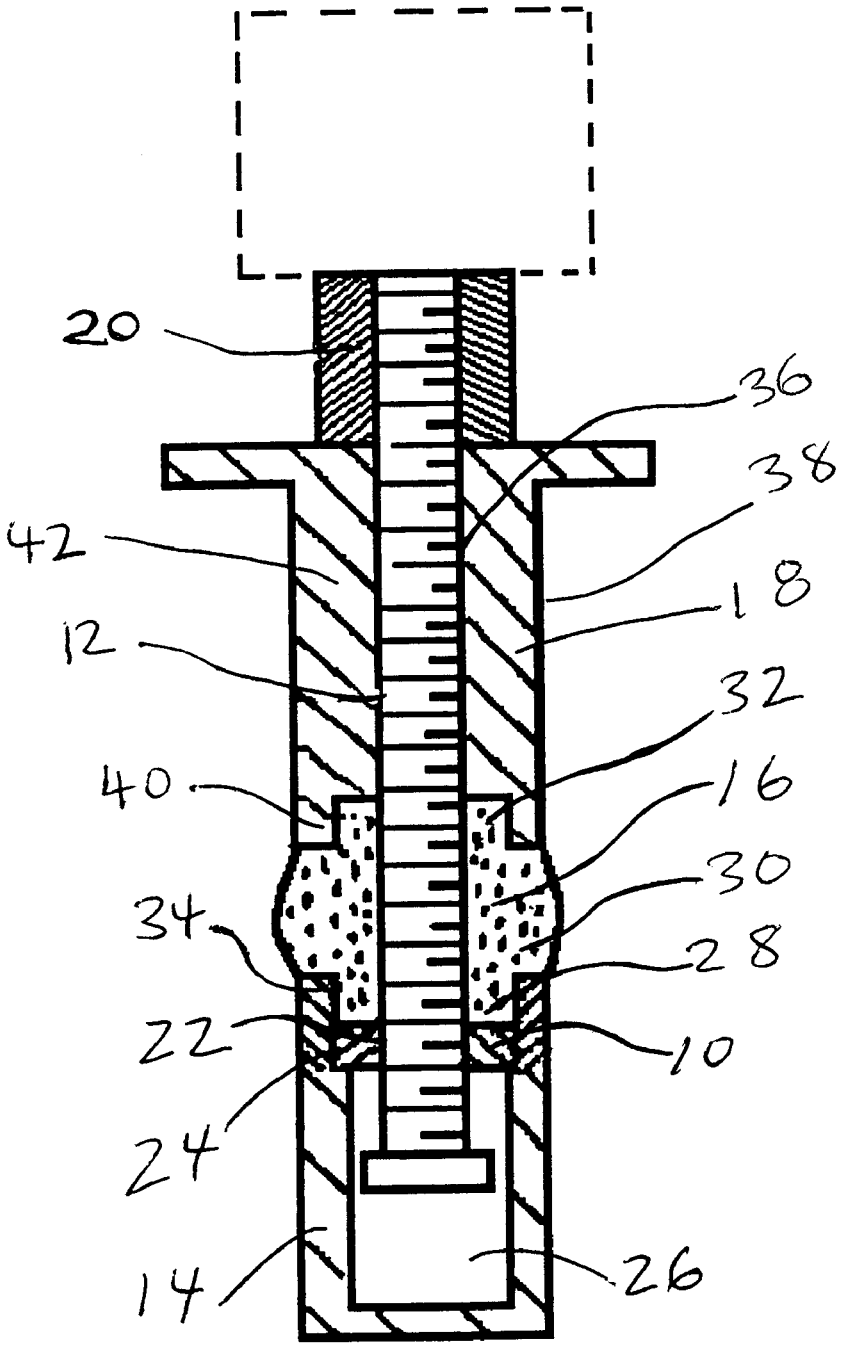

The present invention relates to an adjustable bottle stopper for opened bottles.

In the sparkling wine and gaseous beverage field there is a need for an adjustable bottle stopper that can be adjusted to stopper a variety of bottle necks, that will form airtight seals with the bottle necks of the bottles stoppered, and that can be removed from the bottles stoppered using a minimal amount of force. The standard diameter of most wine bottle necks is 18.5 mm+/−0.5 mm.

In the past, various type of closure devices have been introduced. The devices can be classified into two general groups. The first group are devices that expand inside the mouth of the bottle and the second group are devices that attach to the outside of the neck bottle.

Two immediate problems that may arise with these devices are as follows: (1) the devices fail to produce an airtight seal with the bottles, and (2) the devices that produce an airtight seal are not adjustable for the stopping of a range of bottles. A third problem that may arise is that the devices are not made to be removed with a minimal amount of force from the bottles.

Information relevant to attempts to address these problems can be found in U.S. Pat. Nos. 6,153,275, D404,647, 5,722,548 and 5,813,554. Further relevant information can be found in WO Patent No. WO9918003. However, each one of theses references suffers from one or more of the above disadvantages.

For the foregoing reasons, there is a need for an adjustable bottle stopper that is adjustable to fit inside the neck of bottles having an inside diameter between 16 mm to about 25 mm, that will form an airtight seal with the inside of the neck of the bottle, and that is removable using a minimal amount of physical force.

SUMMARY

The present invention is directed to an adjustable bottle stopper that satisfies the following needs: (1) the need to stopper wine or gaseous bottles in which said bottles have bottle necks that have inside diameters of between 16 mm to about 25 mm, (2) the need that when said bottles are stoppered said bottles produce an airtight seal with the inside of said bottle necks, and (3) the need of removing said bottle stoppers from said bottle necks using a minimal amount of force. An adjustable bottle stopper having features of the present invention comprises a threaded disk nut, a bolt which is screwed into said threaded disk nut until the head of the bolt is flush with one of the ends of the threaded disk nut, a lower pressure stamp nut in which said threaded disk nut is screwed into, a cylindrical elastic spacer that is centrally bored that is mounted on the screw part of the bolt after performing the above steps, an upper pressure stamp, that is centrally bored, that is mounted on top of the cylindrical elastic spacer after said cylindrical elastic spacer is mounted on the bolt, and a handle nut which is screwed and locked on said bolt after said upper pressure stamp is mounted. In an embodiment of the present invention, the upper pressure stamp and the lower pressure stamp nut will serve as sleeves for the cylindrical elastic spacer so that when the device is operational, the cylindrical elastic spacer will expand symmetrically around its periphery when the cylindrical elastic spacer is compressed between the upper pressure stamp and the lower pressure stamp nut. Another embodiment of the adjustable bottle stopper will define the lower pressure stamp nut of being a housing that is a chamber of compression that is calibrated to allow for the expansion of the cylindrical elastic spacer from about 16 mm to about 25 mm. A further embodiment of the bottle stopper will further comprise a nylon washer between the upper pressure stamp and the handle nut to minimize the friction between these two part of the device when the device is being utilized.

An advantage of this invention is that it allows bottles to be stoppered by one multi use bottle stopper that is adjustable and that is easily removable after said bottles have been stoppered.

Another advantage of the invention is that this adjustable bottle stopper does not lend itself to be easily taken apart, this has been a disadvantage in some previous models that have not proved to be functional.

A further advantage in the stopper is that an airtight fit is made between the stopper and the bottle that is being stoppered so that the contents inside the bottle maintain their desired consistency.

DRAWING

Figure 2:
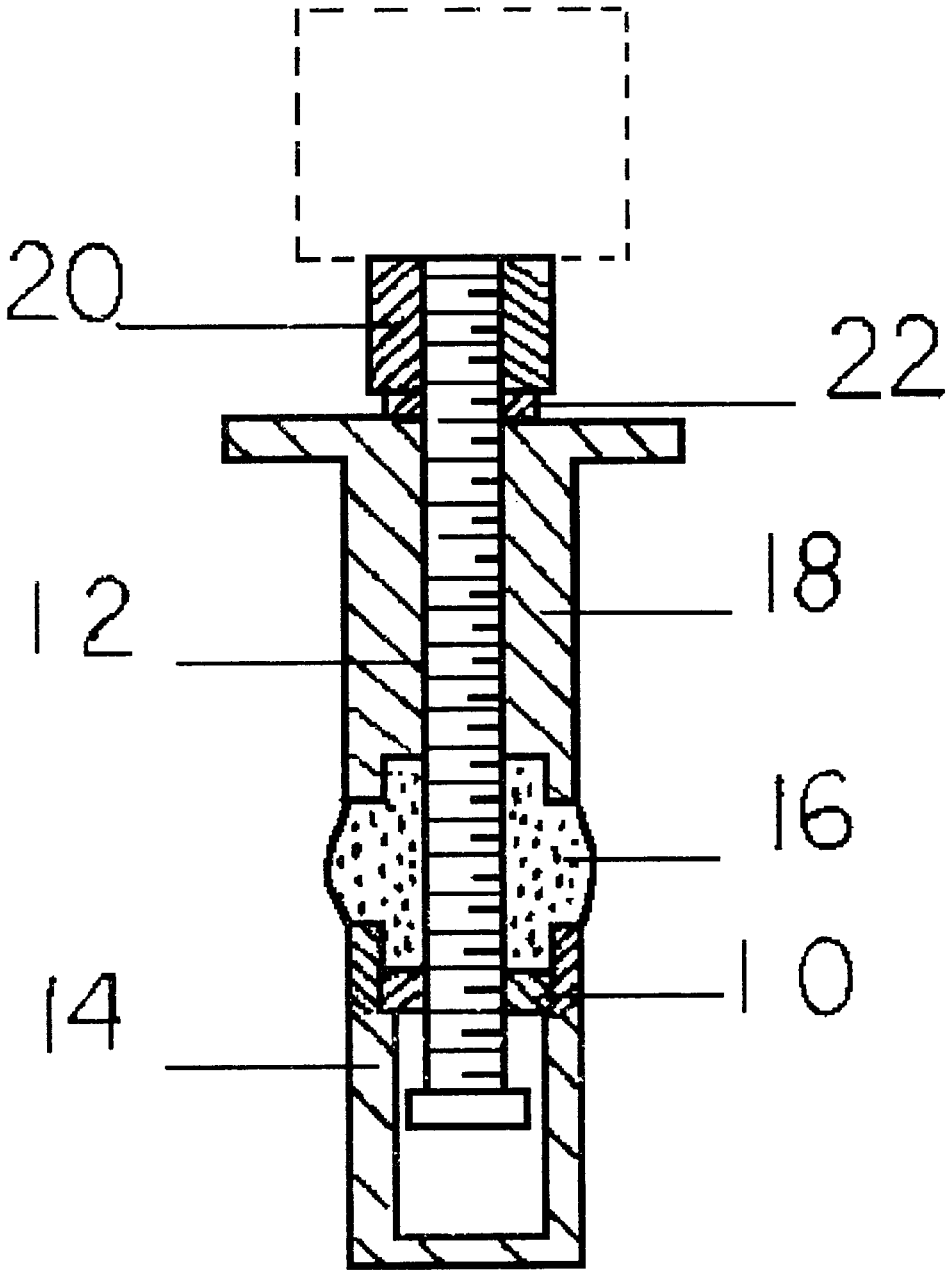

These and other features, aspects, and advantages of the present invention will become better understood with regard to the following description, appended claims, and accompanying drawings where:

FIG. 1 of the drawing shows a full sectional view of one embodiment of the invention, and FIG. 2 of the drawing shows a full sectional view of another embodiment of the present invention.

DESCRIPTION

In order to be better understood, a description of the invention is herewith offered, based on a practical application of the above mentioned drawings.

As shown in FIG. 1, an adjustable bottle stopper comprises a threaded disk nut 10 and a bolt 12 that screws into the threaded disk nut 10. The threaded disk nut 10 is circular and is threaded on its interior 22 and exterior surfaces 24. After screwing the bolt 12 into the threaded disk nut 10, the bolt 12/threaded disk nut 10 assembly is screwed into a lower pressure stamp nut 14. The threads of the lower pressure stamp nut 14 extend a sufficient distance downward so that the threaded disk nut 10 lies within the lower pressure stamp nut 14. This downward extension is the threaded insertion point 34 of the lower pressure stamp nut 14. The lower pressure stamp nut 14, in the preferred embodiments of the invention, has a cavity defined therein allowing for the extension of the head of the bolt 12 into said cavity from about 10 mm to about 15 mm. The cavity forms a chamber 26 for receiving the bolt 12. The lower pressure stamp nut 14 may be made of non-precious metals, precious metals, plastics, and/or polymers that are not reactive with the contents of the liquids being stoppered. A cylindrical elastic spacer 16, centrally bored and mounted on the screw end of the bolt 12, is placed so that the cylindrical elastic spacer 16 lies on top of the threaded disk nut 10 thereby being sleeved within the lower pressure stamp nut 14. The cylindrical elastic spacer 16 has upper 32, lower 28, and central 30 sections and is bored in the middle so that it can fit around the threads of the bolt 12. The cylindrical elastic spacer's 16 upper 32 and lower 28 sections will have circular ledges that will have smaller outside diameters than the central part of the cylindrical elastic spacer's 16 body. The cylindrical elastic spacer 16 will be made of an elastic material, in the preferred embodiment the material will be silicone but it can also be made of rubber or polymers that have elastic qualities. An upper pressure stamp 18, having interior 36 and exterior surfaces 38, is mounted on the threaded part of the bolt 12 after the mounting of the cylindrical elastic spacer 16. The upper pressure stamp 18 will be centrally bored so that it fits around the threaded end of the bolt 12 and the upper pressure stamp 18 will have upper 42 and lower 40 parts. The lower part 40 of the upper pressure stamp 18 is indented from the inner surface going toward the outer surface, said indentation will sleeve the upper section 32 of the elastic spacer's 16 body. In the preferred embodiment, the upper part 42 of the upper pressure stamp 18 will have a larger diameter than its lower part 40 so that when the adjustable bottle stopper is placed inside the neck of a bottle, the upper part 42 of the upper pressure stamp 18 will serve to hold the adjustable bottle stopper on the rim of the bottle. The upper pressure stamp 18 may be made of non-precious metals, precious metals, plastics, and/or polymers. In the preferred embodiment, after sleeving the cylindrical elastic spacer 16 within the upper pressure stamp 18 and the lower pressure stamp nut 10, and no stress being applied to the sleeve assembly, the outer surfaces of the lower pressure stamp 14, the cylindrical elastic spacer 16, and the upper pressure stamp 18 will have equal outside diameters. Lastly, a handle nut 20 is attached to said bolt 12. The handle nut 20 can be made of non-precious metals, precious metals, plastics, and/or polymers. The handle nut 20 can be constructed so that its upper part can hold decorative pieces within it. The handle nut 20 can be locked into place by known means in the art, but in the preferred embodiment an adhesive is placed within the threads of the handle nut 20 and immediately thereafter the bolt 12 is screwed into said handle nut 20 to a length that does not cause any expansion of the cylindrical elastic spacer 16.

FIG. 2. Illustrates another embodiment of the present invention in which a nylon washer 22 is placed between the handle nut 20 and the upper pressure stamp 18. The nylon washer 22 reduces the amount of friction that is generated within these parts when the adjustable bottle stopper is used.

In an embodiment of the invention, the adjustable bottle stopper is calibrated so that the chamber of compression will allow for the expansion of the cylindrical elastic spacer from about 16 mm to about 25 mm. The calibration will depend on the threads used to piece the invention together. In most of the embodiments, the lower pressure stamp nut's 14 chamber of compression will be of a length from about 10 mm to about 15 mm.

After the adjustable bottle stopper is assembled, the invention is used by inserting the bottle stopper inside the neck of an opened bottle. Then one would turn the handle nut 20 in a direction, depending on the threading of the adjustable bottle stopper, until the cylindrical elastic spacer 16 is expanded to a size that will form a perfect seal with the inside of the neck of the bottle. This airtight seal will conserve the quality of the liquid contained within the bottle. When one wants to open the bottle, the handle nut 20 would be turned in the opposite direction than was originally turned to release the adjustable bottle stopper from the bottle.

The advantages of the invention are as follows: (1) the adjustable bottle stopper is not subject to be taken apart by the user during normal use, (2) the adjustable bottle stopper can be used on bottles that have an inside neck bottle diameter of between 16 mm to about 24.5 mm, (3) the adjustable bottle stopper is easily removable, and (4) the adjustable bottle stopper forms an airtight fit with the bottles being stoppered so long as they are in the above range.

Although the present invention has been described in considerable detail with reference to certain preferred versions thereof, other versions are possible. Therefore, the spirit and scope of the appended claims should not be limited to the preferred versions contained herein.

What is claimed is:

1. An adjustable bottle stopper which comprises:

a threaded disk nut having threaded interior and exterior surfaces;

a bolt that screws into said threaded disk nut via the threaded interior surface of said threaded disk nut, the bolt and threaded disk nut thereby forming a threaded disk nut and bolt assembly;

a lower pressure stamp nut having a threaded insertion point, wherein the threaded insertion point receives said threaded disk nut and bolt assembly, said threaded insertion point extends a distance allowing said threaded disk nut to be screwed into a position lower than said threaded insertion point, and said lower pressure stamp nut has a cavity defined therein that when combined with the threaded disk nut forms a chamber for receiving said bolt;

a cylindrical elastic spacer centrally bored and mounted on the bolt, the elastic spacer having upper, lower, and central sections, wherein said cylindrical elastic spacer's upper and lower sections have circular ledges with smaller outside diameters than the central section of the cylindrical spacer, thereby allowing the cylindrical elastic spacer to be sleeved into the threaded insertion point of the lower pressure stamp;

an upper pressure stamp centrally bored having interior and exterior surfaces and mounted on the bolt above the cylindrical elastic spacer, wherein the upper pressure stamp has lower and upper parts, said lower part of the upper pressure stamp indented from the interior surface toward the exterior surface, so that said cylindrical elastic spacer's upper section will be sleeved within said lower part of the upper pressure stamp; and a handle nut attached to said bolt above said upper pressure stamp.

2. The adjustable bottle stopper of claim 1, which further comprises a nylon washer that is placed between the upper pressure stamp and the handle nut.

3. The adjustable bottle stopper of claim 1, wherein said lower pressure stamp nut, said cylindrical elastic spacer and said upper pressure stamp have an outside diameter of equal size when stress is not added to the adjustable bottle stopper.

4. The adjustable bottle stopper of claim 3, wherein said cylindrical elastic spacer is made of silicone.

5. The adjustable bottle stopper of claim 4, wherein the said chamber of compression will be of a length from about ten millimeters to about fifteen millimeters.

6. The adjustable bottle stopper of claim 5, which further comprises a nylon washer that is placed between the upper pressure stamp and the handle nut.

7. The adjustable bottle stopper of claim 1, wherein the chamber for receiving the bolt is calibrated to allow for the expansion of the cylindrical elastic spacer from about sixteen millimeters to about twenty five millimeters.

* * * * *